US008086155B2

(12) United States Patent
Yamaguchi et al.

(10) Patent No.: US 8,086,155 B2
(45) Date of Patent: Dec. 27, 2011

(54) TRANSFER DEVICE AND IMAGE FORMING APPARATUS INCLUDING SAME

(75) Inventors: Toshitaka Yamaguchi, Sagamihara (JP); Kazuchika Saeki, Atsugi (JP); Masaharu Furuya, Yokohama (JP); Takuya Sekine, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 781 days.

(21) Appl. No.: 12/146,925

(22) Filed: Jun. 26, 2008

(65) Prior Publication Data

US 2009/0003864 A1 Jan. 1, 2009

(30) Foreign Application Priority Data

Jun. 26, 2007 (JP) ..... 2007-167804

(51) Int. Cl.
*G03G 15/01* (2006.01)

(52) U.S. Cl. ..... 399/301; 399/302; 399/303

(58) Field of Classification Search ..... 399/301, 399/302, 308, 303
See application file for complete search history.

(56) References Cited

U.S. PATENT DOCUMENTS

| | | | | |
|---|---|---|---|---|
| 5,768,671 | A | 6/1998 | Komiya et al. | |
| 6,148,161 | A | 11/2000 | Usui et al. | |
| 7,263,321 | B2 * | 8/2007 | Inui et al. | 399/301 |
| 2004/0264988 | A1 | 12/2004 | Konishi | |
| 2006/0171748 | A1 | 8/2006 | Inui et al. | |

FOREIGN PATENT DOCUMENTS

| | | |
|---|---|---|
| JP | 5-142906 | 6/1993 |
| JP | 9-211911 | 8/1997 |
| JP | 3473346 | 9/2003 |
| JP | 2006-234862 | 9/2006 |
| JP | 2007-79441 | 3/2007 |

* cited by examiner

*Primary Examiner* — Hoang Ngo

(74) *Attorney, Agent, or Firm* — Oblon, Spivak, McClelland, Maier & Neustadt, L.L.P.

(57) ABSTRACT

A transfer device, which transfers an image onto a recording medium directly or indirectly and is included in an image forming apparatus, includes an endless belt member extended between a drive roller rotated and a driven roller and configured to receive the image from the image carrier part onto either a surface thereof or the recording medium carried on the surface thereof while moving according to rotations of the drive roller, and a rotation speed detector configured to detect a rotation speed of the driven roller. An image detector is provided either to the transfer device or to the image forming apparatus to detect the image formed on the endless belt member directly or the recording medium carried on the endless belt member, and disposed facing the driven roller in a circumferential direction of the endless belt member.

8 Claims, 10 Drawing Sheets

TRANSFER DEVICE AND IMAGE FORMING APPARATUS INCLUDING SAME

CROSS-REFERENCE TO RELATED APPLICATIONS

The present patent application claims priority under 35 U.S.C. §119 from Japanese Patent Application No. 2007-167804, filed on Jun. 26, 2007 in the Japan Patent Office, the contents and disclosure of which are hereby incorporated by reference herein in their entirety.

BACKGROUND OF THE INVENTION

1. Field of the Invention

Exemplary embodiments of the present invention generally relate to a transfer device and an image forming apparatus including the transfer device, and more particularly, to a transfer device including an endless belt to transfer a visible image formed on each of multiple image carriers onto either an endless belt member or a recording medium carried on a surface of the endless belt member to generate a composite toner image, and an image forming apparatus for forming images using the transfer device.

2. Discussion of the Related Art

Image forming apparatuses employing a tandem electrophotographic method are well known, and typically include multiple image carriers to form single-color toner images of different colorants thereon, and a transfer device to sequentially transfer these single-color toner images directly onto a recording medium carried on a belt member serving as a sheet conveying belt or via a belt member serving as an intermediate transfer belt before transferring to the recording medium, so as to form a full-color image in overlay.

In such a tandem electrophotographic image forming apparatus, a change in temperature of optical components such as lens and mirrors of a writing unit can cause fluctuations in optical paths of light, where even a slight fluctuation of optical paths can lead to relative displacement of write start positions between image carriers. When the writing unit starts writing respective latent images while the latent images are relatively out of registration, improperly formed single-color toner images are sequentially transferred onto the belt member or the recording medium, and as a result, a defective full-color image having a color shifted from its original image position is produced.

To correct the above-described color shift, the tandem electrophotographic image forming apparatus forms given toner images or pattern images for misregistration detection at the multiple image carriers that are then transferred onto a belt member in a single layer, detects relative misregistration of the single-color toner images based on a timing with which optical sensors detect the single-color toner images of different colorants in the pattern images, and adjusts writing start timing of the latent images to their respective image carriers as well as any skew or displacement of the optical components based on the above-described detection results. Accordingly, relative misregistration of the single-color toner images between the image carriers can be reduced or prevented.

However, there is another factor contributing to misregistration of the single-color toner images, which is fluctuation in drive speed of a belt member that can be caused by, for example, uneven thickness of the belt member in a direction of movement of the belt member, eccentricity of a drive roller driving the belt member, etc. While the relative displacement of the write start positions of the single-color toner images is related to the image carriers that provides images, the speed fluctuation of a belt member is related to the belt member that receives the images. Consequently, the speed fluctuation of a belt member during a transfer operation can result in misregistration between images, even though the relative positions between the single-color toner images on the image carriers are properly arranged.

More specifically, registration error of respective single-color toner images caused by fluctuation in the speed of the belt member cannot be eliminated by adjustment of the latent image write start timing and/or adjustment of inclination of the optical components. Since misregistration of single-color toner images caused by the relative displacement of the write start positions between the image carriers causes misregistration between the single-color toner images of different colorants, relative positions of dots of the respective single-color toner images in the composite toner image remain substantially unchanged. Therefore, the adjustment of the latent image write start timing or the adjustment of inclination of the optical components or both can reduce or prevent the positional displacement of dots and images between different colorants.

By contrast, misregistration caused by fluctuation in the speed of the belt member varies the relative positions of dots in each single-color toner image between colors, and therefore adjustments of the latent image write start timing and/or of inclination of the optical components cannot eliminate the misregistration.

When the speed fluctuation of the belt member occurs while the optical sensors are detecting pattern images for misregistration detection, the pattern images of different colors cannot be detected properly. Accordingly, the speed fluctuation of the belt member not only causes a color shift in a composite toner image but also prevents a correction of misregistration of respective single-color toner images induced by the relative displacement of the write start positions between the image carriers.

The above-described problems have also occurred in image forming apparatuses employing a multi-cycle electrophotographic printing scheme, in which a belt member rotates more than one time while transferring, per cycle, each visible image formed on an image carrier onto a surface of the belt member or a recording medium carried by the belt member.

Thus, there remains a need for improved transfer devices so as to suppress or eliminate a misregistration-induced color shift in a composite image due to relative displacements of write start positions between multiple image carriers and speed fluctuation of a belt member, and image forming apparatuses that include such a transfer device.

SUMMARY OF THE INVENTION

Exemplary aspects of the present invention have been made in view of the above-described circumstances.

Exemplary aspects of the present invention provide a transfer device that can reduce a color shift in a composite color image due to relative displacements of write start positions between multiple image carriers and due to speed fluctuation of a belt member.

Other exemplary aspects of the present invention provide an image forming apparatus including the above-described transfer device.

In one exemplary embodiment, a transfer device to transfer an image onto a recording medium directly or indirectly includes an endless belt member, an image detector, and a rotation speed detector. The endless belt member that is extended between a drive roller rotated by a drive source thereof and a driven roller rotated with the drive roller, is configured to receive the image formed on a surface of an image carrier part of an image forming apparatus onto either a surface thereof or the recording medium carried on the surface thereof while moving according to rotations of the drive roller. The image detector is configured to detect the image formed on the endless belt member directly or the recording medium carried on the endless belt member, and disposed facing the driven roller in a circumferential direction of the endless belt member. The rotation speed detector is configured to detect a rotation speed of the driven roller.

The image detector may be positioned based on a position of the driven roller with a positioning member, at an upstream side from the drive roller in a belt travel direction, and facing an outer surface of the endless belt member where an inner surface thereof is held in contact with the driven roller.

The image detector may include multiple sensors disposed along a longitudinal axis of the driven roller.

Further, in one exemplary embodiment, a transfer device to transfer an image onto a recording medium directly or indirectly includes an endless belt member, a cover, and a rotation speed detector. The endless belt member, which is extended between a drive roller rotated by a drive source thereof and a driven roller rotated with the drive roller, is configured to receive the image formed on a surface of an image carrier part of an image forming apparatus onto either a surface thereof or the recording medium carried on the surface thereof while moving according to rotations of the drive roller. The cover covers an outer surface of the endless belt member, including either an opening therein or a window made of transparent material and disposed facing an area where the driven roller supports the endless belt member in a direction of movement of the endless belt member. The image detector is fixed to an image forming apparatus to detect the image formed on the endless belt member through the opening or the window in the cover. The rotation speed detector is configured to detect a rotation speed of the driven roller.

The cover may include multiple openings or multiple windows disposed along a longitudinal axis of the driven roller.

Further, in one exemplary embodiment, an image forming apparatus includes an image carrier part configured to carry an image on a surface thereof, an image forming mechanism configured to form the image on the surface of the image carrier part, and a transfer device including an endless belt member and a rotation speed detector. The endless belt member is extended between a drive roller rotated by a drive source and a driven roller rotated with the drive roller, and configured to receive the image from the image carrier part onto either a surface thereof or the recording medium carried on the surface thereof while moving according to rotations of the drive roller. The rotation speed detector is configured to detect a rotation speed of the driven roller.

The transfer device may further include an image detector configured to detect the image formed on the endless belt member directly or the recording medium carried by the endless belt member. The image detector may be disposed facing the driven roller in a circumferential direction of the endless belt member.

The image carrier part may include multiple individual image carriers configured to carry respective images thereon. The transfer device may sequentially transfer the respective images onto either the endless belt member or the recording medium carried on the endless belt member.

The above-described image forming apparatus may further include an image detector and a cover. The image detector may be configured to detect the image formed on the endless belt member directly or the recording medium carried on the endless belt member, and disposed facing the driven roller in a circumferential direction of the endless belt member. The cover may cover an outer surface of the endless belt member, including either an opening therein or a window made of transparent material and disposed facing an area where the driven roller supports the endless belt member in a direction of movement of the endless belt member. The image detector may detect the image formed on the endless belt member through the opening or the window in the cover.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 1 is a cross-sectional view of a schematic configuration of a printer as an image forming apparatus according to an exemplary embodiment of the present invention;

DETAILED DESCRIPTION OF THE PREFERRED EMBODIMENTS

Figure 1:
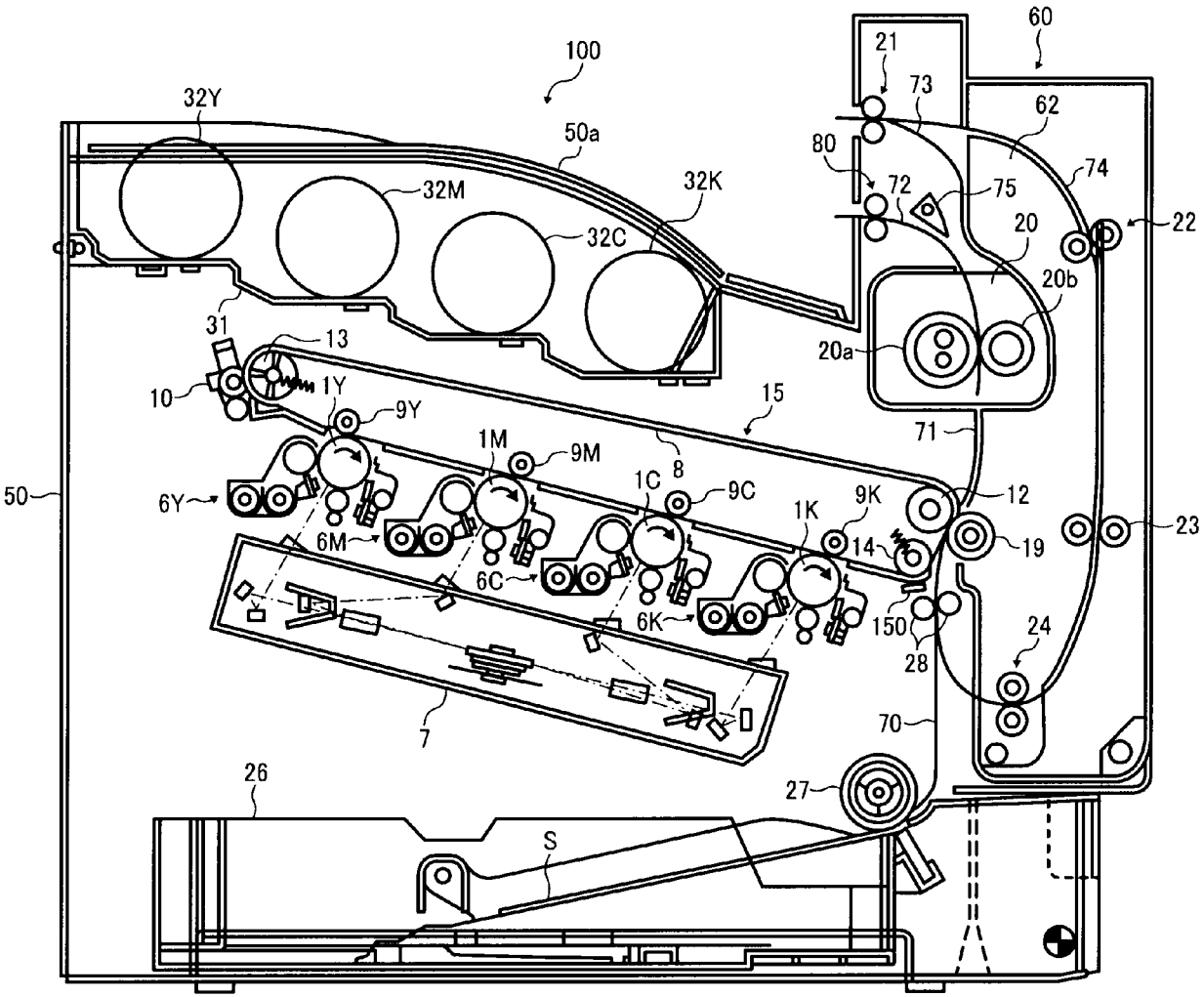
FIG. 1 is

In describing preferred embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring now to the drawings, wherein like reference numerals designate identical or corresponding parts throughout the several views, preferred embodiments of the present invention are described.

Figure 2:
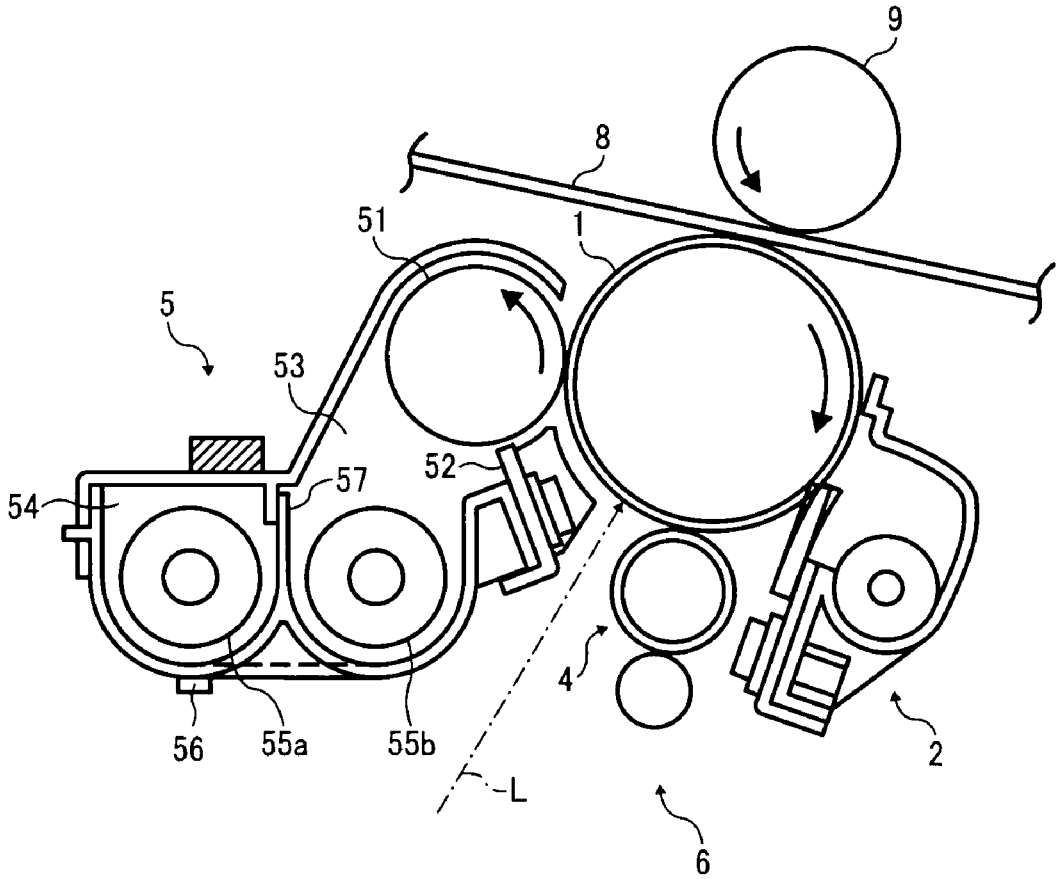
FIG. 2 is an enlarged view of a process cartridge and image forming components disposed around the process cartridge included in the printer of FIG. 1.

Referring to FIGS. 1 and 2, a schematic configuration of a printer 100 serving as an electrophotographic image forming apparatus according to an exemplary embodiment of the present invention is described.

The printer 100 shown in FIG. 1 includes four process cartridges 6Y, 6M, 6C, and 6K as an image forming mechanism, four toner bottles 32Y, 32M, 32C, and 32K as a toner feeding mechanism, an optical writing device 7, a transfer device 15 as a transfer mechanism, a sheet feeding cassette 26 as a sheet feeding mechanism, and a fixing device 20 as a fixing mechanism. The above-described mechanisms are included in a housing 50 of the printer 100.

The housing 50 also includes an optical sensor unit 150 facing an intermediate transfer belt 8, which is included in the transfer device 15, at a position in the vicinity of one of supporting rollers of the intermediate transfer belt 8. Details of the optical sensor unit 150 will be described later.

The process cartridges 6Y, 6M, 6C, and 6K include respective consumable image forming components to perform image forming operations for producing individual toner images of different colors of yellow (Y), magenta (M), cyan (C), and black (K). The process cartridges 6Y, 6Mc, 6C, and 6K are separately arranged at positions having different heights in a stepped manner and are detachably provided to the printer 100 so that each of the process cartridges 6Y, 6M, 6C, and 6K can be replaced once at an end of its useful life. Since the four process cartridges 6Y, 6M, 6C, and 6K have similar structures and functions, except that respective toners are of different colors, which are yellow, magenta, cyan, and black toners, the discussion below uses reference numerals for specifying components of the printer 100 without suffixes of colors such as Y, M, C, and K.

FIG. 2 shows an enlarged view of the process cartridge 6 for producing a single-color toner image.

The process cartridge 6 has image forming components therearound. The image forming components included in the process cartridge 6 are a photoconductive drum 1 (1Y, 1M, 1C, and 1K in FIG. 1), a drum cleaning unit 2, a diselectrifying or discharging unit, not shown, a charging unit 4, a developing unit 5, and so forth.

The photoconductive drum 1 serves as an image carrier or an image carrier part in a form of a rotating member including a cylindrical conductive body having a relatively thin base. In the printer 100 according to the exemplary embodiment of the present invention, a drum type image carrier such as the photoconductive drum 1 is used, but not limited to. Alternatively, the present invention can apply a belt type image carrier.

The drum cleaning unit 2 removes residual toner remaining on the surface of the photoconductive drum 1.

The charging unit 4 including a charging roller, not shown, is applied with a charged voltage. When the photoconductive drum 1 is driven by a rotation drive unit, not shown, as a rotation drive mechanism, and is rotated clockwise in FIG. 2, the charging unit 4 applies the charged voltage to the photoconductive drum 1 to uniformly charge the surface of the photoconductive drum 1 to a predetermined polarity.

The developing unit 5 of FIG. 2 develops an electrostatic latent image formed on the surface of the photoconductive drum 1 into a single-color toner image. Thus, the toner image is formed on the surface of the photoconductive drum 1.

The developing unit 5 includes a developing roller 51, a doctor blade 52, a first supplying portion 53, a second supplying portion 54, first and second toner conveying screws 55*a* and 55*b*, a toner density sensor 56, and a dividing plate 57.

The developing roller 51 is disposed in the developing unit 5 to cause a portion of the developing roller 51 to be exposed from an opening of a casing of the developing unit 5.

The first toner conveying screw 55*a* and the second toner conveying screw 55*b* are disposed in parallel with each other in the developing unit 5.

The casing of the developing unit 5 includes developer, not shown. The developer includes a magnetic carrier and a single-color toner corresponding to image data. The developer is frictionally charged to a predetermined polarity while being agitated by the first toner conveying screw 55*a* and the second toner conveying screw 55*b*. The developer is then conveyed onto the surface of the developing roller 51. The doctor blade 52 regulates the developer conveyed to the surface of the developing roller 51 to a predetermined thickness or height so that the regulated developer can be conveyed to a developing area located opposite to the photoconductive drum 1. At this time, toner included in the developer is transferred onto an electrostatic latent image formed on the surface of the photoconductive drum 1 according to the image data. The above-described transfer of toner is used to form a single-color toner image on the surface of the photoconductive drum 1. The developer remaining on the developing roller 51 is conveyed back to the casing of the developing unit 5 as the developing roller 51 rotates.

The dividing plate 57 is disposed between the first toner conveying screw 55*a* and the second toner conveying screw 55*b* so as to divide the developing unit 5 into the first supplying portion 53 and the second supplying portion 54.

The first supplying portion 53 accommodates the developing roller 51 and the second toner conveying screw 55*b*. The second supplying portion 54 accommodates the first toner conveying screw 55*a*. The second toner conveying screw 55*b* is driven by a drive unit, not shown, to supply the developer to the developing roller 51 while the developer in the first supplying portion 53 is conveyed from the front side to the rear side in a longitudinal direction of the first supplying portion 53. The developer conveyed by the second toner conveying screw 55*b* to the vicinity of the far end portion of the first supplying portion 53 is further conveyed through an opening, not shown, of the dividing plate 57 into the second supplying portion 54. In the second supplying portion 54, the first toner conveying screw 55*a* is driven by a drive unit, not shown, to convey the developer conveyed from the first supplying portion 53 to the direction opposite to the second toner conveying screw 55*b*. That is, the developer in the second supplying portion 54 is conveyed from the rear side to the front side in a longitudinal direction of the second supplying portion 54 of the developing unit 5 of the printer 100. The developer conveyed by the first toner conveying screw 55*a* to the vicinity of the near end portion of the second supplying portion 54 is further conveyed through a different opening, not shown, of the dividing plate 57 back into the first supplying portion 53.

The toner density sensor 56 is hereinafter referred to as a "T-sensor". The T-sensor 56 is a permeability sensor and is disposed on an outside of the bottom plate of the second supplying portion 54 so as to output a voltage of a value according to a permeability of the developer passing above the T-sensor 56. Since the permeability of a two-component developer including toner and magnetic carrier has a preferable correlation with a toner density, the T-sensor 56 can output a voltage according to the toner density of the corresponding color of toner. The value of the output voltage is sent to a control unit 200 that is shown later in FIG. 3.

The control unit 200 includes a random access memory (RAM) storing a target value Vtref of the corresponding color of the output voltage from the T-sensor 56. The RAM includes respective target values Vtref for yellow, magenta, cyan, and black toners of the output voltages from the respective T-sensors 56 mounted on the respective developing units 5.

For example, the target value Vtref for yellow toner may be used to control a yellow toner conveying unit, not shown. More specifically, the control unit 200 controls the yellow toner conveying unit to supply the yellow toner in the second supplying portion 54. The output voltage from the T-sensor 56 is determined by the amount of the corresponding toner detected, and toner is continuously supplied until the output voltage matches the target value Vtref. The replenishment of toner can maintain the toner density in the developer at a predetermined level. The above-described operation is identical for the magenta, cyan, and black toners.

As shown in FIG. 1, the four toner bottles 32Y, 32M, 32C, and 32K independently detachable from each other are arranged at a position between the transfer device 15 and a stacker 50*a*, and are supported by a bottle supporting portion 31. The toner bottles 32Y, 32M, 32C, and 32K are also separately provided with respect to the respective process cartridges 6Y, 6M, 6C, and 6K, and are detachably arranged to the printer 100. With the above-described configuration, each toner bottle may easily be replaced with a new toner bottle when the toner bottle is detected as being in a toner empty state, for example.

The optical writing device 7 shown in FIG. 1 is a part of the image forming mechanism, and emits four laser light beams towards the photoconductive drums 1Y, 1M, 1C, and 1K. When the optical writing device 7 emits a laser light beam L (see FIG. 2) toward the photoconductive drum 1 of the process cartridge 6 (6Y, 6M, 6C, and 6K in FIG. 1), the laser light beam L is deflected by a polygon mirror, not shown, which is also driven by a motor. The laser light beam L travels via a plurality of optical lenses and mirrors, and reaches the photoconductive drum 1. The process cartridge 6 receives the laser light beam L, which is optically modulated. The laser light beam L, according to image data corresponding to a color of toner for the process cartridge 6, irradiates a surface of the photoconductive drum 1 through a path formed between the charging unit 4 and the developing unit 5, so that an electrostatic latent image is formed on the charged surface of the photoconductive drum 1.

In FIG. 1, the transfer device 15 is arranged above the process cartridges 6Y, 6M, 6C, and 6K. The transfer device 15 includes the intermediate transfer belt 8, four primary transfer bias rollers 9Y, 9M, 9C, and 9K, a belt cleaning unit 10, a secondary transfer backup roller 12, a cleaning backup roller 13, and a tension roller 14.

The intermediate transfer belt 8 includes a multilayer structure of a base layer and a top layer. The base layer includes less extendable resins such as fluorine contained resin, PVDF sheet, and polyimide resin. The base layer is covered by the top layer including a resin, such as a fluorine resin, with high toner releasing ability. The intermediate transfer belt 8 forms an endless belt member spanned around or extending over the secondary transfer backup roller 12, the cleaning backup roller 13 and the tension roller 14, and rotates counterclockwise in FIG. 1. The intermediate transfer belt 8 is also held in contact with the primary transfer bias rollers 9Y, 9M, 9C, and 9K corresponding to the photoconductive drums 1Y, 1M, 1C, and 1K, respectively, to form respective primary transfer nips between the photoconductive drum 1Y and the primary transfer roller 9Y, between the photoconductive drum 1M and the primary transfer roller 9M, and so forth.

Corresponding to the photoconductive drum 1 of FIG. 2, the primary transfer bias roller 9 is arranged at a position opposite to the photoconductive drum 1. With the above-described configuration, the toner image formed on the surface of the photoconductive drum 1 can be transferred onto the intermediate transfer belt 8.

The primary transfer bias roller 9 receives a transfer voltage having an opposite polarity to the charged toner to transfer the transfer voltage to an inside surface of the intermediate transfer belt 8. For example, when the charged toner is applied to a negative polarity, the primary transfer bias roller 9 receives the transfer voltage with a positive polarity. The rollers except the primary transfer bias roller 9 are grounded.

Through operations similar to those as described above, yellow, magenta, cyan, and black images are formed on the surfaces of the respective photoconductive drums 1Y, 1M, 1C, and 1K. Those color toner images are sequentially overlaid on the surface of the intermediate transfer belt 8, such that a primary overlaid toner image is formed on the surface of the intermediate transfer belt 8. Hereinafter, the primary overlaid toner image is referred to as a full-color toner image.

The transfer unit 15 also includes a separation mechanism, not shown, to separate the intermediate transfer belt 8 from the photoconductive drums 1Y, 1M, and 1C while the intermediate transfer belt 8 is continuously held in contact with the photoconductive drum 1K. The separation mechanism is used when the printer 100 performs an image forming operation for producing a black-and-white image.

After the toner image formed on the surface of the photoconductive drum 1 is transferred onto the surface of the intermediate transfer belt 8, the drum cleaning unit 2 removes residual toner on the surface of the photoconductive drum 1. Further, the diselectrifying unit removes the charges remaining on the surface of the photoconductive drum 1 so that the photoconductive drum 1 can be ready for a subsequent printing operation.

In FIG. 1, the sheet feeding cassette 26 accommodates a plurality of recording media such as transfer sheets that include an individual transfer sheet S that serves as a recording medium. The sheet feeding mechanism also includes a sheet feeding roller 27 and a pair of registration rollers 28. The sheet feeding roller 27 is held in contact with the transfer sheet S. The sheet feeding roller 27 is rotated by a roller drive motor, not shown, the transfer sheet S placed on the top of a stack of transfer sheets in the sheet feeding cassette 26 is fed into a sheet conveying path 70 and is conveyed to a portion between rollers of the pair of registration rollers 28. The pair of registration rollers 28 stops and feeds the transfer sheet S in synchronization with a movement of the four color toner image towards a secondary transfer area, which is a secondary nip portion formed between the intermediate transfer belt 8 and a secondary transfer bias roller 19.

The secondary transfer bias roller 19 is applied with an adequate predetermined transfer voltage so that the four color toner image formed on the surface of the intermediate transfer belt 8 is transferred onto the transfer sheet S. The four color toner image transferred on the transfer sheet S is referred to as a full-color toner image.

The belt cleaning unit 10 removes residual toner adhering on the surface of the intermediate transfer belt 8.

The transfer sheet S that has the full color toner image thereon is conveyed further upward via a post-transfer sheet conveying path 71, and passes between a pair of fixing rollers of the fixing device 20.

The fixing device 20 is detachable with respect to the housing 50 and includes a heat roller 20*a* having a heater therein, for example a halogen lamp, and a pressure roller 20*b* for pressing the transfer sheet S for fixing the four color toner image. The fixing unit 20 fixes the four color toner image to the transfer sheet S by applying heat and pressure.

After passing the fixing device 20, the transfer sheet S is discharged by a pair of sheet discharging rollers 80 to the stacker 50*a* provided at the upper portion of the printer 100.

The transfer sheet S that passed the fixing device 20 comes to a branching point of a sheet discharging path 72 and a pre-reverse sheet conveying path 73. A switching pawl 75 is swingably or rotatably disposed at the branching point so that the swing of the switching pawl 75 can select either path for the transfer sheet S to forward. More specifically, when the tip of the switching pawl 75 is moved toward the pre-reverse sheet conveying path 73, the transfer sheet S is conveyed to the sheet discharging path 72. On the other hand, when the tip of the switching pawl 75 is moved away from the pre-reverse sheet conveying path 73, the transfer sheet S is conveyed to the pre-reverse sheet conveying path 73.

When the switching pawl 75 has selected the direction to guide the transfer sheet S to the sheet discharging path 72, the transfer sheet S is conveyed through the sheet discharging path 72 and a pair of sheet discharging rollers 80, and is discharged and stacked on the stacker 50*a* on the top of the housing 50 of the printer 100.

When the switching pawl 75 has selected the direction to guide the transfer sheet S to the pre-reverse sheet conveying path 73, the transfer sheet S is conveyed through the pre-reverse sheet conveying path 73 and comes to the nip of a pair of reverse rollers 21. The pair of reverse rollers 21 feeds the transfer sheet S toward the stacker 50*a*, stops immediately before the trailing edge of the transfer sheet S passes the nip of the pair of reverse rollers 21, and reverses the rotation thereof. The reverse of rotation of the pair of reverse rollers 21 conveys the transfer sheet S in the opposite direction so as to cause the leading edge of the transfer sheet S to enter into a reverse sheet conveying path 74.

The reverse sheet conveying path 74 is included in a cover 60, and is formed in a bow shape and extends downwardly in a vertical direction. The reverse sheet conveying path 74 includes a first pair of reverse conveying rollers 22, a second pair of reverse conveying rollers 23, and a third pair of reverse conveying rollers 24 therein. The transfer sheet S is vertically reversed by sequentially passing through the nips of the first, second, and third pairs of reverse conveying rollers 22, 23, and 24. The vertically reversed transfer sheet S returns to the sheet conveying path 70, and comes to the secondary transfer nip again. At this time, the transfer sheet S is forwarded to the secondary transfer nip while contacting the other side having no image thereon with the surface of the intermediate transfer belt 8 so that the full-color toner image formed on the intermediate transfer belt 8 can be transferred onto the other side of the transfer sheet S. The transfer sheet S is conveyed via the post-transfer sheet conveying path 71, the fixing unit 20, the sheet discharging path 72, and the pair of sheet discharging rollers 80, and is discharged to the stacker 50*a*. With the above-described reverse operation with respect to the transfer sheet S, the full-color toner image can be formed on both sides of the transfer sheet S.

Figure 3:
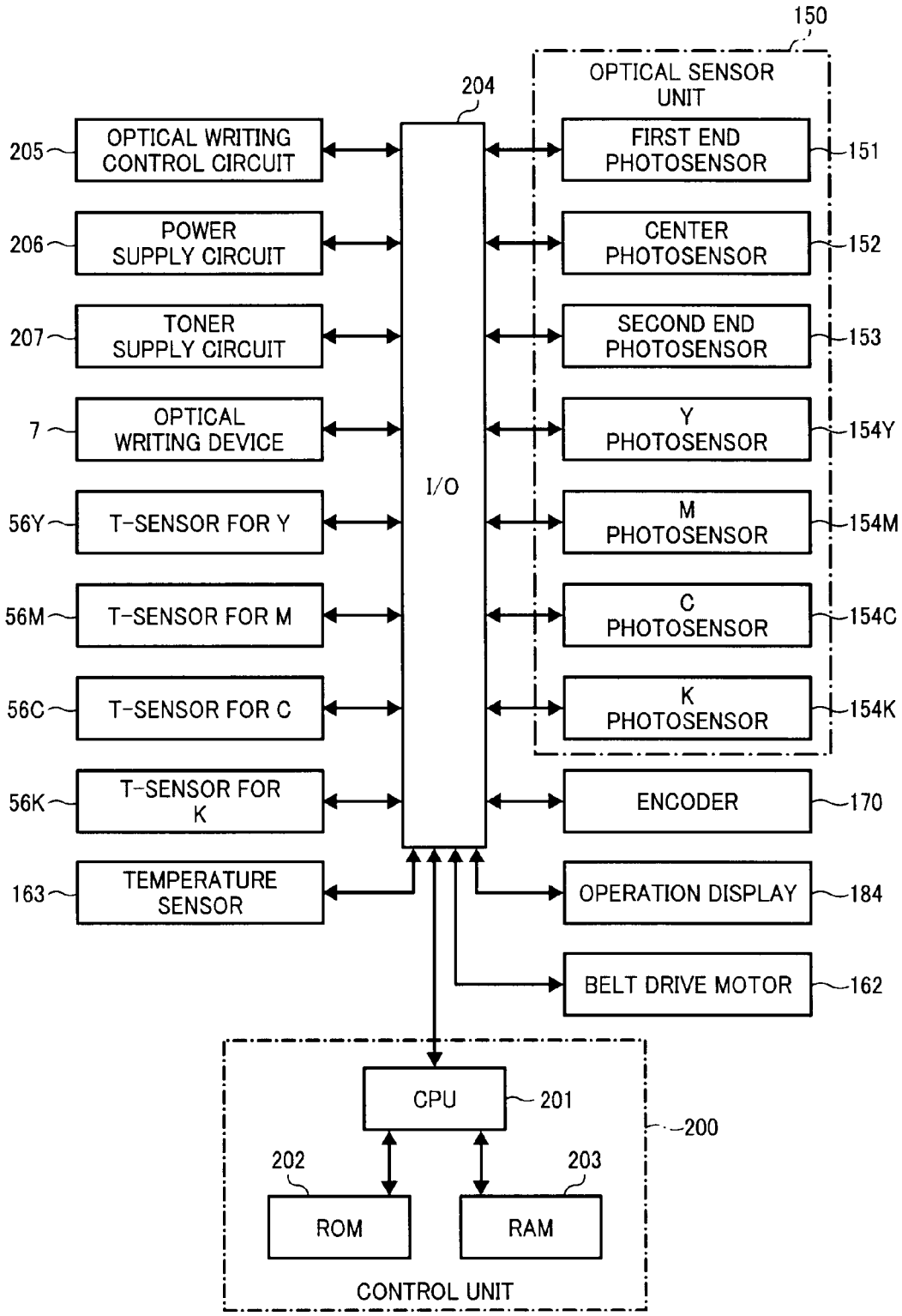
FIG. 3 is a block diagram showing a portion of electric circuits of the printer of FIG. 1.

Referring to FIG. 3, a block diagram showing a portion of electric circuits of one exemplary embodiment of the printer 100 is described.

In FIG. 3, the printer 100 includes the optical sensor unit 150, the control unit 200, and an input and output (I/O) interface 204.

The control unit 200 serving as a calculating unit for the operations of the printer 100 includes a center processing unit or CPU 201, a read only memory or ROM 202 storing various control programs and data, and a random access memory or RAM 203 temporarily storing the various data.

The I/O interface 204 receives and sends various signals with respect to the peripheral control units.

The control unit 200 is connected via the I/O interface 204 to the optical writing device 7, T-sensors 56Y, 56M, 56C, and 56K, an optical writing operation control circuit 205, a rotary encoder (hereinafter, "encoder") 170, a belt drive motor 162, a temperature sensor 163, and an operation display 184. The optical writing operation control unit 205 is dedicated to the controls of the optical writing device 7, a power supply circuit 206, and a toner supply circuit 207. The belt drive motor 162 is a drive source that drives the drive roller 12 to move the intermediate transfer belt 8. The temperature sensor 163 detects temperature inside the printer 100.

The control unit 200 is also connected to the optical sensor unit 150. The optical sensor unit 150 includes a first end photosensor 151, a center photosensor 152, a second end photosensor 153, a photosensor for yellow toner or a yellow toner photosensor 154Y, a photosensor for magenta toner or a magenta toner photosensor 154M, a photosensor for cyan toner or a cyan toner photosensor 154C, and a photosensor for black toner or a black toner photosensor 154K. The photosensors 154Y, 154M, 154C, and 154K are reflective type photosensors, each including a light emitting element that emits light to a target member and a light receiving element that receives the light reflected from the target member. The target member includes a belt member (e.g., the intermediate transfer belt 8), a recording medium (e.g., the transfer sheet S), and the like.

The optical writing operation control circuit 205 controls the optical writing unit 7 based on instructions issued by the control unit 200 via the I/O interface 204.

The power supply circuit 206 applies a high voltage to the charging unit 4 of the process cartridge 6 based on instructions issued by the control unit 200 via the I/O interface 204, and applies a development bias to the developing roller 51 of the developing unit 5.

The toner supply circuit 207 controls the toner bottles 32Y, 32M, 32C, and 32K serving as the toner feeding mechanism, based on instructions issued by the control unit 200 via the I/O interface 204, so as to control the amounts of toner replenished from the toner bottles 32Y, 32M, 32C, and 32K to the corresponding developing units including the developing unit 5.

The control unit 200 sends instructions based on the output values output from the T-sensors 56Y, 56M, 56C, and 56K via the I/O interface 204 to the toner supply circuit 207. According to the instructions, the toner densities of the two-component developer accommodated in the respective developing units 5 may be kept in a reference toner density level.

Figure 4:
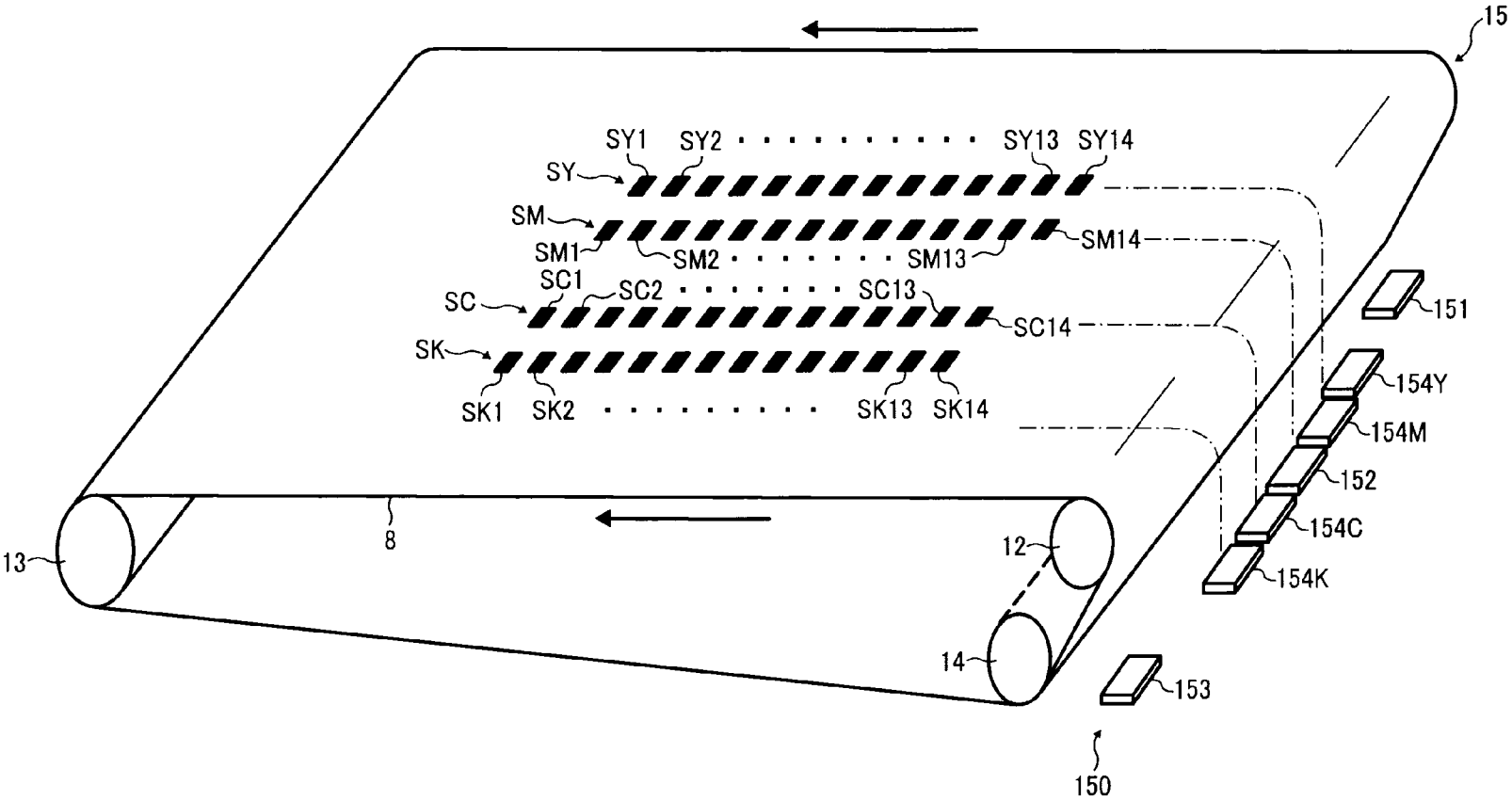
FIG. 4 is a perspective view of an intermediate transfer belt, included in a transfer device of the printer of FIG. 1, with reference toner images formed thereon.

Referring to FIG. 4, a schematic structure of the intermediate transfer belt 8 with reference toner images formed thereon is described.

The printer 100 performs an image forming condition adjusting process for adjusting the image forming condition for the image forming units including the optical writing device 7 and the process cartridges 6Y, 6M, 6C, and 6K at a given timing (e.g., each time a given time elapses). In the image forming condition adjusting process, a process control operation and a misregistration correction operation are performed. The operations include a control operation controlling the optical writing device 7 by the optical writing control circuit 205 based on instructions input from the control unit 200 through the I/O interface 204 and a control operation controlling driving of each of the process cartridges 6Y, 6M, 6C, and 6K and the transfer device 15 by the control unit 200. By performing the operations, gradation pattern images for detecting image density and patch pattern images including toner images for detecting misregistration are formed on the intermediate transfer belt 8.

Specifically, in the process control operation, Y, M, C, and K gradation pattern images for detecting the image density are formed on the intermediate transfer belt 8. Each gradation pattern image includes 14 reference toner images each having a given pixel pattern. Different amount of toner is adhered to each reference toner image, in other words, each reference toner image has a different image density.

For example, a K-gradation pattern image SK shown in FIG. 4 includes 14 K-reference toner images (K-reference toner images SK1, SK2, . . . SK13, and SK14) in which the amount of the toner adhered thereto is gradually increased in stages. The K-reference toner images are formed on the front surface of the intermediate transfer belt 8 with given intervals therebetween in a direction to which the intermediate transfer belt 8 moves. The amount of toner adhered per unit area in each K-reference toner image is detected by the K photosensor 154K. A detection result of detecting the toner adhered per unit area is sent to the RAM 203 through the I/O interface 204 as output values Vpi (i=1 to 14).

The photosensors 153, 154K, 154C, 152, 154M, 154Y, and 151 are aligned in this order in a belt width direction of the intermediate transfer belt 8 or in a rotary axis of the supporting rollers. The K photosensor 154K is arranged to be aligned with the K-reference toner images in the belt width direction to detect the K-reference toner images. In the same manner, the Y photosensor 154Y, the M photosensor 154M, and the C photosensor 154C are aligned with Y-reference toner images, M-reference toner images, and C-reference toner images, respectively. The output values Vp1 to Vp14 from each of the Y, M, and C photosensors 154Y, 154M, and 154C, which are the detection result of detecting the toner amount adhered to each of the Y, M, and C reference toner images, are stored in the RAM 203.

The control unit 200 converts each output value into the toner amount per unit area adhered to each reference toner image based on the output values stored in the RAM 203 and a data table stored in the ROM 202, and stores them as toner adhesion amount data in the RAM 203.

Figure 5:
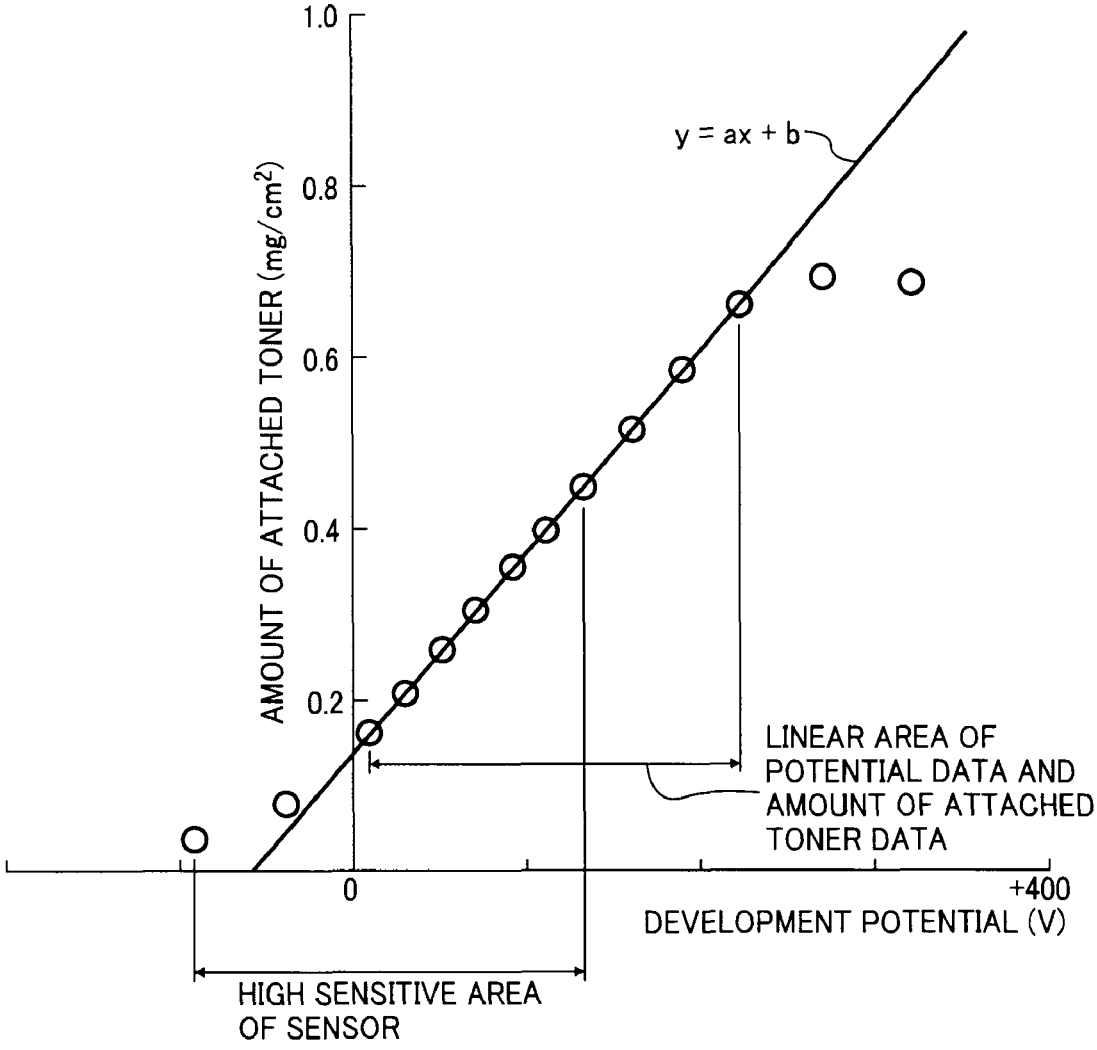
FIG. 5 is a graph representing a relation between a potential of a photoconductor included in the process cartridge of FIG. 2 and a toner adhesion amount plotted on X-Y coordinates.

FIG. 5 is a graph representing a relation between a potential of the photoconductor and the toner adhesion amount plotted on X-Y coordinates, in which an X-axis represents a development potential (V) (a difference between a developing bias voltage at the timer of forming the gradation pattern images and a surface potential of the photoconductors 1K, 1Y, 1M, and 1C), and a Y-axis represents a toner adhesion amount per unit area (mg/cm$^2$).

The control unit 200 selects the area in which a relation between the potential data and the toner adhesion amount data (development characteristics) shows a linear characteristic for each color based on the potential data and the toner adhesion amount data stored in the RAM 203, and performs smoothing on the data in the area. The development characteristics of each developing unit 5 are linearly approximated by using the least-squared method to the potential data and the toner adhesion amount data after the smoothing. Furthermore, after calculating an equation of a straight line (y=ax+b) for the development characteristics of each developing unit 5, the image forming condition for each process unit is adjusted based on the gradient "a" of the equation of the straight line. A method for adjusting the image forming condition includes a method in which a potential of a uniformly charged photoconductor or a developing bias is adjusted. In the case of employing a two-component developing method, a control target value of a toner density of the two-component developer can be adjusted.

As shown in FIG. 4, in the process control operation, the K-gradation pattern image KS including 14 K reference toner images SK1, SK2, . . . , SK13, and SK14 aligned at given intervals in the direction of movement of the intermediate transfer belt 8 or in a sub-scanning direction is formed. The C-gradation pattern image SC including 14 C reference toner images SC1, SC2, . . . , SC13, and SC14 aligned at given intervals in the sub-scanning direction is formed adjacent to the K-gradation pattern image SK in a main scanning direction or the belt width direction. The M-gradation pattern image SM including 14 M reference toner images SM1, SM2, . . . , SM13, and SM14 aligned at given intervals in the sub-scanning direction is formed adjacent to the C-gradation pattern image SC in a main scanning direction or the belt width direction. The Y-gradation pattern image SY including 14 Y reference toner images SY1, SY2, . . . , SY13, and SY14 aligned at given intervals in the sub-scanning direction is formed adjacent to the M-gradation pattern image SM in a main scanning direction or the belt width direction.

Figure 6:
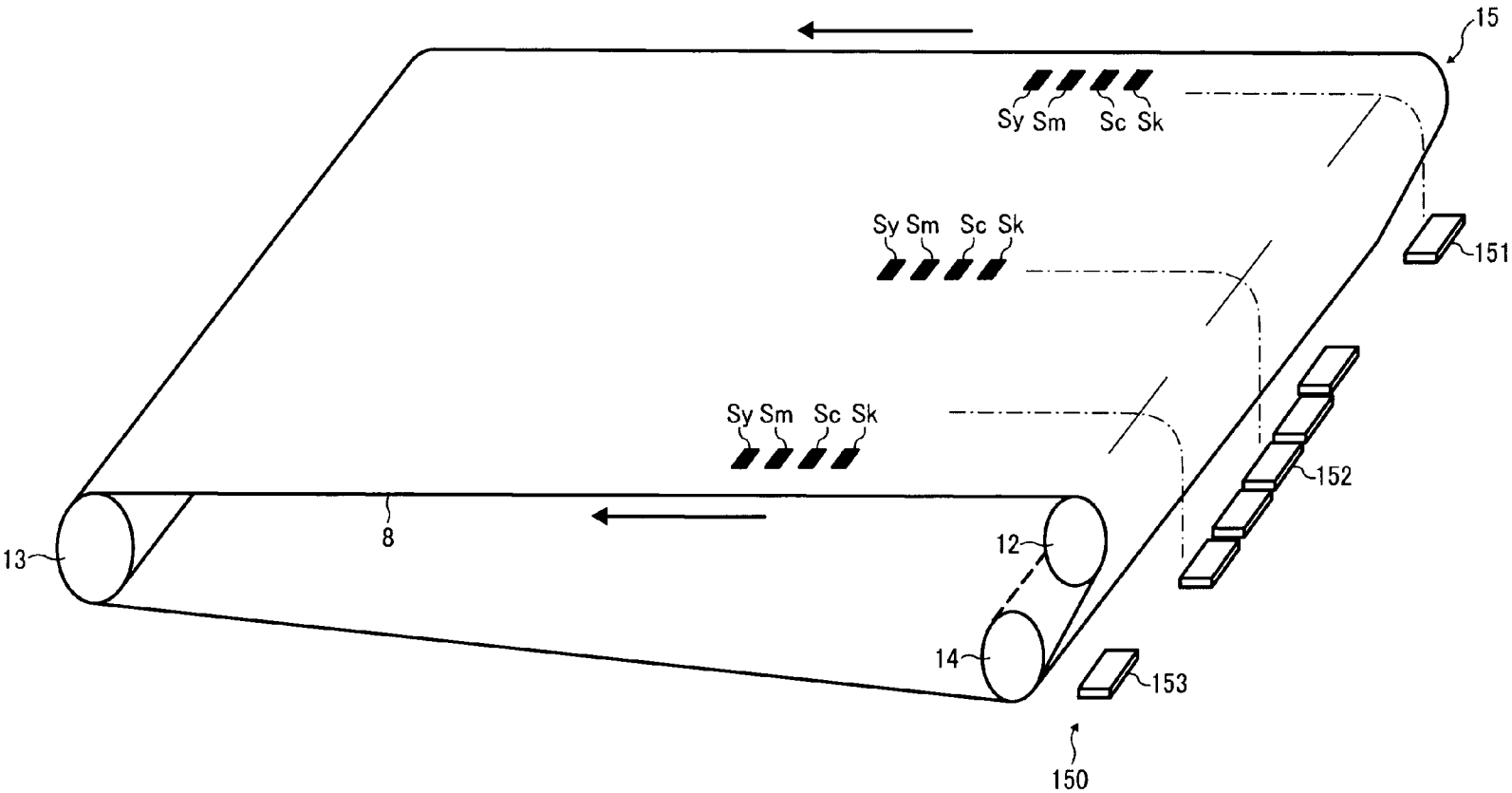
FIG. 6 is a perspective view of the intermediate transfer belt with reference toner images different from FIG. 4.

In the misregistration correction operation, the patch pattern images for detecting misregistration are formed near both ends and center of the intermediate transfer belt 8 in the belt width direction as shown in FIG. 6. The patch pattern images each includes Y, M, C, and K reference toner images Sy, Sm, Sc, and Sk aligned at given intervals in the sub-scanning direction, and the reference toner images with the same color are aligned in the main scanning direction.

In FIG. 6, the reference toner images in the patch pattern image formed near the edge of the far-side in the belt width direction are detected by the first end photosensor 151, the reference toner images in the patch pattern image formed near the center in the belt width direction are detected by the center photosensor 152, and the reference toner images in the patch pattern image formed near the edge of the near-side in the belt width direction are detected by the second end photosensor 153. When the reference toner images of each color are formed at an appropriate timing, the interval to detect the reference toner images of each color becomes equal. By contrast, when the reference toner images of each color are not formed at an appropriate time, the interval to detect the reference toner images of each color becomes different. When a displacement does not occur in the optical system for optical writing, the reference toner images of each color are detected at the same time between the patch pattern images; however, when a displacement occurs in the optical system for optical writing, the reference toner images of each color are not detected at the same time between the patch pattern images. The control unit 200 adjusts the timing to start the optical writing on each photoconductive drum 1 or the optical system based on the difference of the interval or the time to detect each toner image in the main scanning direction or the sub-scanning direction, thereby suppressing the misregistration of each toner image.

When the gradation pattern images or the patch pattern images are formed, the secondary transfer roller 19 is separated from the intermediate transfer belt 8, so that the gradation pattern images or the patch pattern images are prevented from being transferred onto the secondary transfer roller 19.

A displacement correction is performed by adjusting the gradient of a mirror for returning the laser beam of each color that is arranged in the optical writing unit 7. A stepping motor is used as a driving source for tilting the mirror.

The misregistration correction of each toner image in the sub-scanning direction or the direction of movement of the intermediate transfer belt 8 is performed by adjusting the timing to start the optical writing on each photoconductive drum 1.

Figure 7:
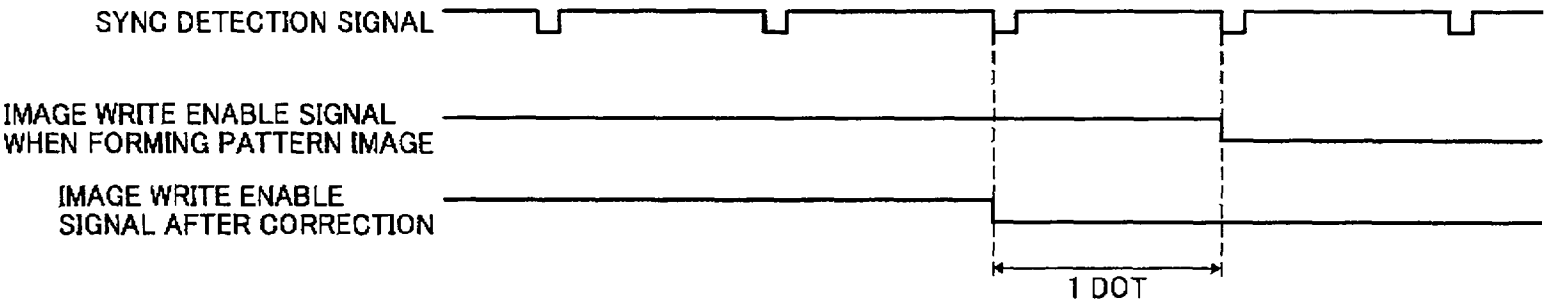
FIG. 7 is a drawing of a timing chart showing timings of occurrence of various signals when correcting timings to start optical writing in a sub-scanning direction of an image.

FIG. 7 is a drawing of a timing chart showing timings of occurrence of various signals when correcting timings to start the optical writing in a sub-scanning direction of an image.

In FIG. 7, rises (ONs) and falls (OFFs) of an enable signal of writing a latent image or an image write enable signal, which serves as an image area signal in a sub-scanning direction, is controlled by time corresponding to one dot of an image. In other words, a resolution to correct the image write enable signal equals to a period of time corresponding to one dot of an image. By reflecting on the polygon mirror, the reflected laser light for optical writing reciprocally scans in a main scanning direction of an image or in a rotational axis direction of the photoconductive drum 1. On detecting the laser light for optical writing in the vicinity of edge of a scanning area in the main scanning direction, a synchronization (or sync) detection signal is generated and transmitted. The image write enable signal is adjusted according to the sync detection signal. For example, when the timing to start the optical writing with respect to the photoconductive drum 1 is set forward by one dot of an image in a sub-scanning direction, a fall timing of the image write enable signal is put forward by one sync detection signal, as shown in FIG. 7.

Figure 8:
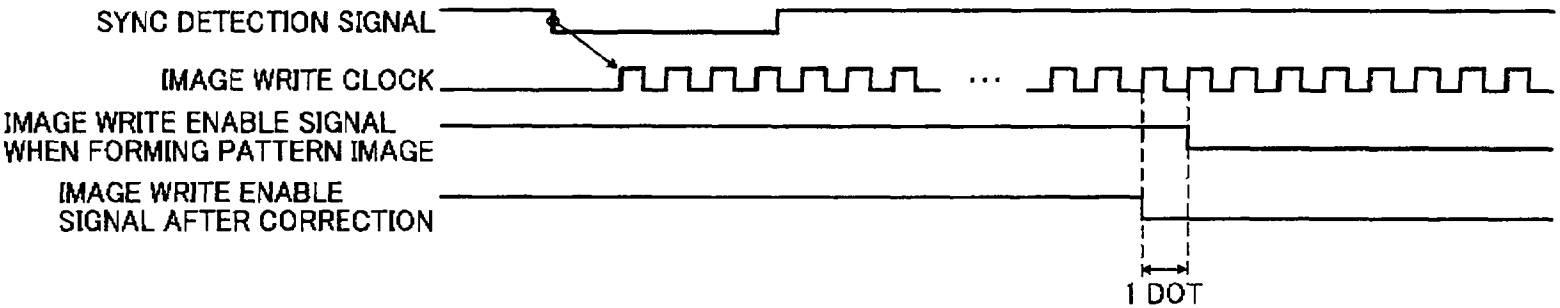
FIG. 8 is a drawing of a timing chart showing timings of occurrence of an image write clock when correcting timings to start optical writing in a sub-scanning direction of an image.

FIG. 8 is a drawing of a timing chart showing timings of occurrence of an image write clock when correcting timings to start optical writing in a sub-scanning direction of an image.

Similar to the timing chart of FIG. 7, the timing chart of FIG. 8 includes a resolution to correct the image write enable signal equals to a period of time corresponding to one dot of an image. In this timing chart of FIG. 8, the image write clock is determined to obtain a clock pulse in precise synchronization with each line at the falling edge of the sync detection signal. The optical writing starts in synchronization with the image write clock, and the image write enable signal in the main scanning direction is also produced in synchronization with the image write clock. When the timing to start the optical writing with respect to the photoconductive drum 1 is set forward by one dot of an image in the sub-scanning direction based on a detection timing of each reference toner image in the above-described pitch pattern images, the image write enable signal is simply set active ahead by one sync detection signal, as shown in FIG. 8.

A patch pattern image in black (K) is a reference color with respect to other patch pattern images in yellow (Y), magenta (M), and cyan (C). When reference toner images of yellow (Y), magenta (M), and cyan (C) patch pattern images each has deviation in magnification in the main scanning direction, a device such as a color generator that can adjust the frequency of signal in significantly small steps can correct the deviated magnification(s).

Figure 9:
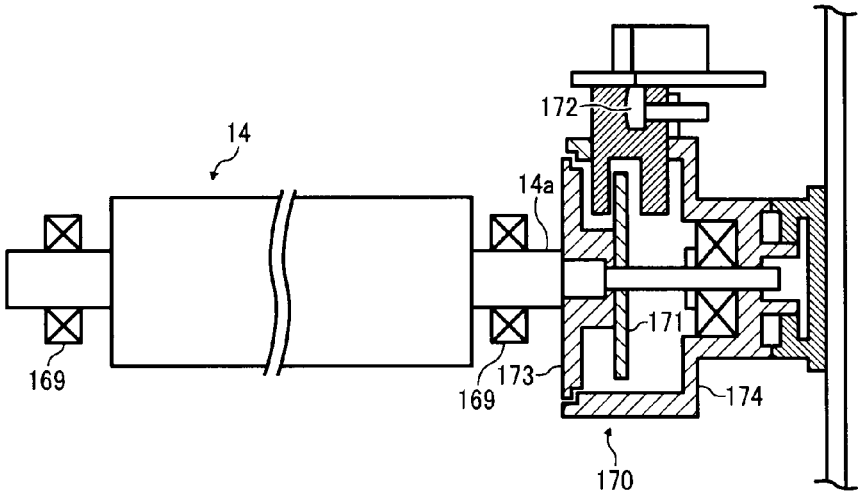
FIG. 9 is an enlarged cross-sectional view of an encoder roller disposed inside a loop of the intermediate transfer belt and an encoder disposed at one end portion of the encoder roller.

FIG. 9 is an enlarged cross-sectional view of the encoder roller 14 and the encoder 170.

The encoder roller 14 includes stainless steel, serves as a driven roller disposed inside the loop of the intermediate transfer belt 8, as shown in FIG. 6, and rotates with the movement of the intermediate transfer belt 8. The encoder roller 14 includes a shaft 14*a*, both ends extending in a longitudinal axis. One end portion of the shaft 14*a* extends to taper its diameter in three steps. The shaft 14*a* is rotatably supported, at both ends of the encoder roller 14, by bearings 169 each of which mounted on a corresponding supporting plate of the transfer device 15.

The encoder 170 covers one end portion of the shaft 14*a* of the encoder roller 14, and includes a code wheel 171, a transmission photosensor 172, a supporting plate 173, and a cover 174.

The supporting plate 173 includes a resin material such as polyacetal resin, and is softly press fit to a surface opposite the leading edge of the shaft 14*a* of the encoder roller 14.

The code wheel 171 is disk-shaped and fixedly mounted on the shaft 14*a* so as to rotate with the shaft 14*a*. The code wheel 171 is fixed to one surface of the supporting plate 173, i.e., to an opposite surface to a direction of press fitting via a double-faced tape, not shown.

The leading edge of the shaft 14*a* of the encoder roller 14 is rotatably supported by the corresponding bearing 169, so as to more accurately position the supporting plate 173 to which the code wheel 171 is fixed.

Figure 10:
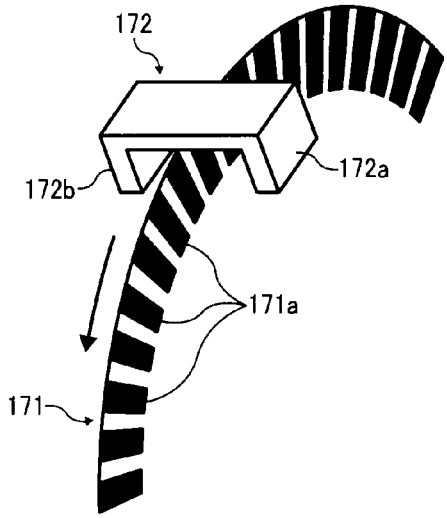
FIG. 10 is an enlarged view of a code wheel of the encoder of FIG. 9 and a transmission photosensor disposed in the vicinity of the code wheel.

The code wheel 171 is disk-shaped, has a thickness of approximately 0.2 mm, and includes polyethylene terephthalate or PET having a thickness of approximately 0.2 mm. As shown in FIG. 10, the disk-shaped code wheel 171 includes slits 171*a* radially arranged along an outer edge thereof. These slits 171*a* are formed by use of a technique of pattern drawing with photoresist.

Figure 11:
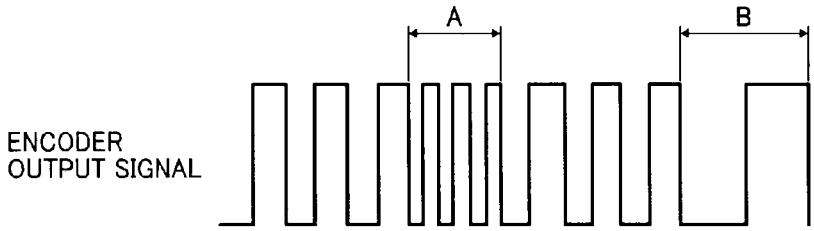
FIG. 11 is a graph showing a frequency of a characteristic of an output signal from the transmission photosensor of FIG. 10.

The transmission photosensor 172 includes a light emitting device 172*a* and a light receiving device 172*b*, facing each other and sandwiching but not contacting the slits 171*a* therebetween with given intervals. With the rotation of the code wheel 171, each slit 171*a* passes between the light emitting device 172*a* and the light receiving device 172*b* so as to repeatedly transmit and receive light in a short cycle. That is, the light emitting device 172*a* transmits light and the light receiving device 172*b* receives the light transmitted from the light emitting device 172*a* while the slit 171*a* of the code wheel 171 passes therebetween, thereby increasing an output voltage from the transmission photosensor 172 to HIGH level. By contrast, the communication of light between the light emitting device 172*a* and the light receiving device 172*b* is blocked or interfered while the surface of the code wheel 171 passes therebetween, thereby decreasing the output voltage to LOW level. These operations constantly repeat in a short period. According to the above-described operations, an encoder output signal changes the shape of its waveform as indicated as "A" and "B" in FIG. 11 in response to changes of a rotation angular velocity (hereinafter, referred to as an angular velocity) of the encoder roller 14, and therefore the control unit 200 obtains the rotation angular velocity of the encoder roller 14 based on the various lengths of the frequency of the encoder output signal. After obtaining the detection result of the angular velocity of the encoder roller 14 obtained based on the output of the encoder 170, the control unit 200 feeds back the detection result to a drive speed of the belt drive motor 162.

In a tandem electrophotographic image forming apparatus such as the printer 100, it is desirable that the intermediate transfer belt 8 rotates at a constant speed. In fact, however, unevenness in thickness in a circumferential direction of the intermediate transfer belt 8 and/or eccentricity of the drive roller 12 can fluctuate the speed of movement of the intermediate transfer belt 8. Speed fluctuation of movement of the intermediate transfer belt 8 causes the intermediate transfer belt 8 to come off its target course. The shift from the target position of the intermediate transfer belt 8 sets up disalignment of each write start position of a toner image formed on the photoconductive drums 1Y, 1M, 1C, and 1K in the direction of movement of the intermediate transfer belt 8, thereby generating a color shift in an overlaid image.

Further, when the speed of the intermediate transfer belt 8 is relatively fast, a portion of the toner image transferred on the intermediate transfer belt 8 may be drawn in a circumferential direction of the intermediate transfer belt 8, which can result in a defective image deformed from an original image. By contrast, when the speed of the intermediate transfer belt 8 is relatively slow, a portion of the toner image transferred on the intermediate transfer belt 8 may be reduced from the original image in the circumferential direction of the intermediate transfer belt 8. As a result, when the deformed toner image is transferred onto a recording medium, the toner image shows a periodical change in density thereon in the circumferential direction of the intermediate transfer belt 8, which is called "banding."

A relation between uneven in thickness of the belt and change in speed may be described as follows.

When the drive roller 12 driving the intermediate transfer belt 8 supports a rather thick part of the intermediate transfer belt 8, a speed of the intermediate transfer belt 8 may be faster than a given speed thereof. When the drive roller 12 supports a rather thin part of the intermediate transfer belt 8, the speed of the intermediate transfer belt 8 may be slower than the given speed thereof. As a result of the above-described conditions, fluctuation in speed of the intermediate transfer belt 8 may be caused during one cycle thereof.

When a belt is formed using a centrifugal molding and the mold for forming the belt is eccentric, the eccentricity of the mold can easily cause the uneven thickness of the belt to satisfy a relation having phase difference of 180 degrees between a portion having a maximum thickness and a portion having a minimum thickness per rotation of the belt. Such a belt includes a characteristic that the fluctuation of speed of the belt per rotation of the belt forms a sine curve for one rotation thereof.

Eccentricity of the drive roller 12 can also cause a speed fluctuation of the intermediate transfer belt 8. Generally, the perimeter of the drive roller 12 is smaller than the perimeter of the intermediate transfer belt 8. Therefore, the characteristics of fluctuation formed in a sine curve due to the eccentricity of the drive roller 12 frequently appear per full circle of the intermediate transfer belt 8.

The eccentricity of the drive roller 12 is caused by a surface thereof mainly including an elastic layer such as a rubber material, and the like. Specifically, a turning process can relatively easily fabricate the drive roller 12 including metallic materials only and being substantially free from eccentricity. However, in the purpose of preventing slippage of the intermediate transfer belt 8 on the surface of the drive roller 12, it is general to cover an elastic layer around a surface of the metallic core. However, even though the drive roller 12 is made by the turning process to be free from eccentricity as a metallic core, the drive roller 12, uneven thickness in the elastic layer of the intermediate transfer belt 8 may generate eccentricity.

Accordingly, the printer 100 includes a configuration to feed back the detection result of the angular velocity of the encoder roller 14 obtained based on the output from the encoder 170, that is, the speed fluctuation of the intermediate transfer belt 8, to the drive speed of the belt drive motor 162. More specifically, when it is determined that the angular speed is slower than a control target value, the control unit 200 increases the number of clock pulses to the belt drive motor 162 to accelerate the rotation speed of the belt drive motor 162. By contrast, when it is determined that the angular speed is faster than the control target value, the control unit 200 decreases the number of clock pulses to the belt drive motor 162 to reduce the rotation speed of the belt drive motor 162. By performing such a feed back control, the intermediate transfer belt 8 can move at a stable speed.

Next, a characteristic configuration of the printer 100 according to the present invention is described.

As previously described, by controlling the drive speed of the belt drive motor 162 based on the detection result of the angular speed of the encoder roller 14, the printer 100 reduces the speed fluctuation of the intermediate transfer belt 8. By so doing, when the toner images formed on respective photoconductors 1Y, 1C, 1M, and 1K are transferred onto the intermediate transfer belt 8 to form a composite toner image, a color shift in the composite toner image due to the speed fluctuation of the intermediate transfer belt 8 can be reduced or prevented. With such a configuration, patch pattern images for detecting misregistration of the composite toner image transferred from the respective photoconductive drums 1Y, 1C, 1M, and 1K onto the intermediate transfer belt 8 do not include misregistration due to the speed fluctuation of the intermediate transfer belt 8. Therefore, the control unit 200 causes the optical sensor unit 150 to detect only the misregistration of the reference toner images due to light path fluctuations of the optical writing device 7.

As shown in FIGS. 4 and 6, the printer 100 includes the optical sensor unit 150 including multiple photosensors. The multiple photosensors are arranged facing a specific portion of the outer surface of the intermediate transfer belt 8 where the encoder roller 14 supports the intermediate transfer belt 8 in the entire circumferential direction.

When the angular velocity of the encoder roller 14 disposed facing the optical sensor unit 150 becomes stable, the speed of movement of the intermediate transfer belt 8 can be stable as well. Therefore, it is contemplated that the speed of the intermediate transfer belt 8 is most stable at a portion where the surface of the intermediate transfer belt 8 faces the optical sensor unit 150. Consequently, by moving the patch pattern images for detecting misregistration on the intermediate transfer belt 8 at the portion where the intermediate transfer belt 8 faces the optical sensor unit 150 at a stable speed, the optical sensor unit 150 can precisely detect the misregistration of each reference toner image caused by the fluctuations of light paths of the optical writing device 7.

As a result, the above-described configuration can effectively prevent misregistration of color on an overlaid image caused by the fluctuation of light path of the optical writing unit 7 and by the fluctuation of speed of the intermediate transfer belt 8.

Accuracy of positional alignment in the above-described misregistration correction operation needs to be measured with a micron-order precision. In such a positional alignment requiring high precision, the optical sensor unit 150 may need to detect the patch patterns of FIG. 5 with high accuracy.

However, when the roller supporting the intermediate transfer belt 8 at the portion facing the optical sensor unit 150 rotates irregularly, i.e., in a bent, deflective, or eccentric manner, each photosensor of the optical sensor unit 150 may become off focus, thereby loosing desirable detection accuracy.

An acceptable range of deviation of a general driven roller is from approximately 0.3 mm to approximately 0.5 mm. Therefore, such an irregular rotation of the supporting roller cannot obtain sufficient detection accuracy.

To meet recent demands for high performance of image forming apparatuses, the tolerance range of the driven roller 14 disposed facing the optical sensor unit 150 may be particularly reduced. For example, in the past, one photosensor had detected four gradation pattern images sequentially to perform the process control or patch pattern images to perform the misregistration correction (only in the sub-scanning direction). Such a configuration employing one photosensor had sequentially formed and detected the gradation pattern images and the patch pattern images, which had taken a long process time. By contrast, as shown in FIG. 4, recent image forming apparatuses have included multiple photosensors disposed in a longitudinal axis of the supporting rollers including the encoder roller 14. By so doing, the toner pattern images and patch pattern images of respective colors can be concurrently formed or detected, thereby reducing the operation time for process control and misregistration correction. However, such a configuration employing the multiple photosensors needs to maintain respective detection accuracies of the multiple photosensors, and therefore oscillation of the multiple photosensors needs to be prevented over an entire area in the longitudinal axis of the encoder roller 14. As a result, the tolerance range of oscillation of the multiple photosensors is extremely reduced.

The encoder roller 14 shown in FIGS. 4 and 6 corresponds to a driven roller. However, different from a general driven roller, the encoder roller 14 detects a rotation angular velocity of the intermediate transfer belt 8.

When the encoder roller 14 having the above-described function becomes bow-shaped, oscillates, or rotates eccentrically, the rotation angular speed of the encoder roller 14 changes even though the intermediate transfer belt 8 moves at a constant speed. This change prevents accurate detection of the rotation angular velocity of the intermediate transfer belt 8. Therefore, the encoder roller 14 is made highly rigid so as not to become bent or oscillate and is free from eccentricity or deformation that are removed by a high precision process. An acceptable range of oscillation is generally set to from approximately 0.05 mm to approximately 0.1 mm.

In the printer 100, such a highly rigid, non-eccentric and/or non-deformed encoder roller 14 is disposed facing the optical sensor unit 150 via the intermediate transfer belt 8. Therefore, from the purpose of the encoder roller 14 to obtain a proper rotation speed, a roller having a same acceptable range as a known roller can prevent deterioration of accuracy to detect misregistration caused by the irregular rotation of the roller at the portion facing the optical sensor unit 150 can be prevented at the same time. With this configuration, a roller that is highly rigid, non-eccentric and/or non-deformed like a known roller can serve as the encoder roller 14 to increase the detection accuracy of rotation speed of the roller and the detection accuracy of misregistration of the roller.

Figure 12:
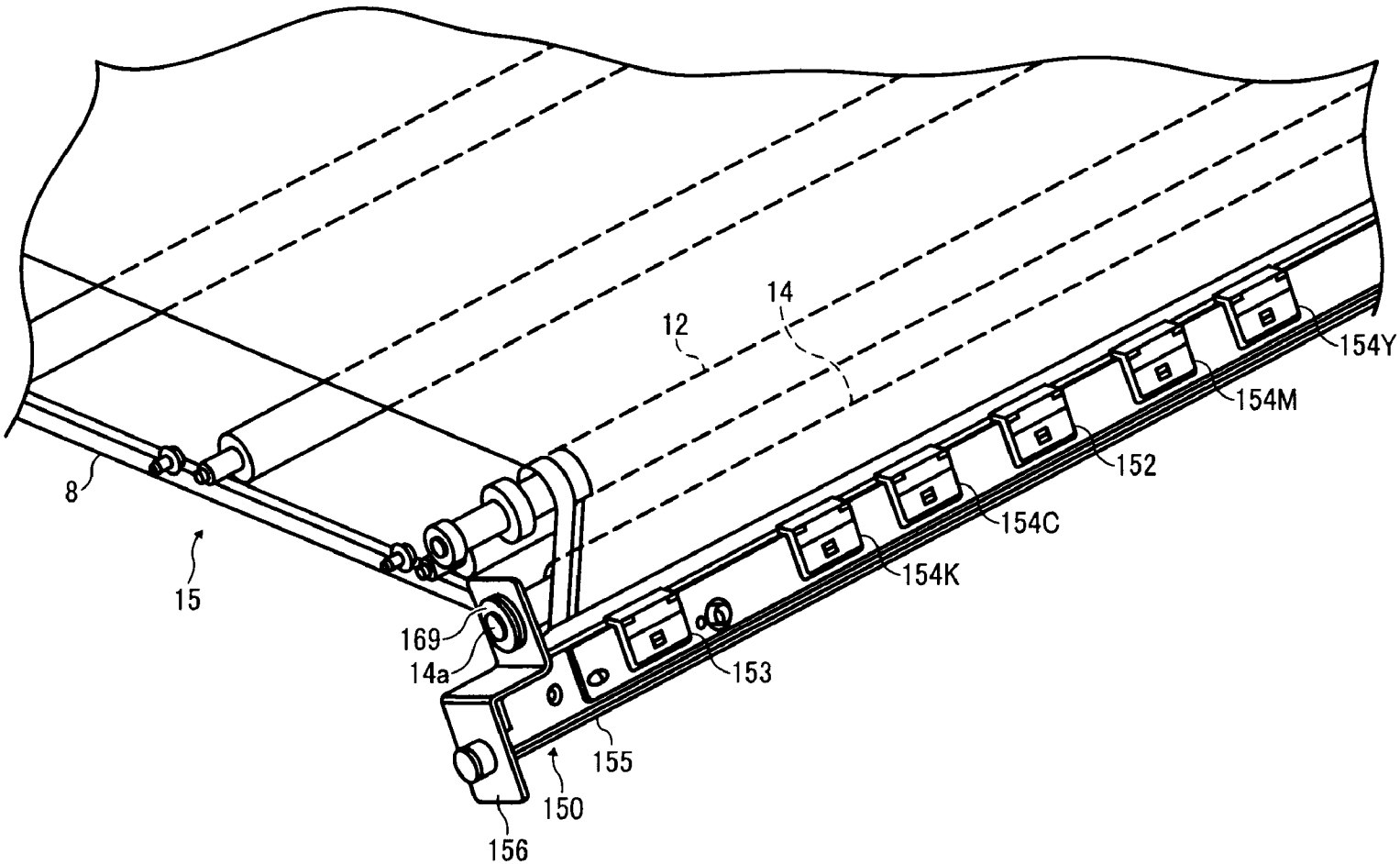
FIG. 12 is a partial enlarged view of one end portion of the transfer device in a direction of movement of the intermediate transfer belt and multiple photosensors.

Referring to FIG. 12, a schematic configuration of the transfer device 15 according to an exemplary embodiment of the present invention is described.

FIG. 12 is a partial enlarged view of one end portion of the transfer device 15 in a direction of movement of the intermediate transfer belt 8. As shown in FIG. 12, the optical sensor unit 150 includes a support plate 155 to mount photosensors thereon. The support plate 155 is long-shaped, extending in a width direction of the intermediate transfer belt 8 or a longitudinal axis of the rollers supporting the intermediate transfer belt 8, such as the secondary transfer backup roller 12 and the encoder roller 14. In FIG. 12, the support plate 155 includes the center photosensor 152, the second end photosensor 153, the Y photosensor 154Y, the M photosensor 154M, the C photosensor 154C, and the K photosensor 154K. The support plate 155 also includes the first end photosensor 151, which is not shown in FIG. 12.

A positioning angle 156, which serves as a positioning member and has a round hole therein, is fixed at both ends in a longitudinal direction of the support plate 155. By engaging the round hole of the positioning angle 156 with a circumferential surface of the bearing 169 that rotatably supports the shaft 14*a* of the encoder roller 14, the optical sensor unit 150 is positioned at an upstream side from the secondary transfer backup roller 12 in a belt travel direction, and facing the outer surface of the intermediate transfer belt 8 where the inner surface thereof is held in contact with the encoder roller 14. That is, the positioning angle 156 engages the optical sensor unit 150 having the photosensors 151, 152, 153, 154Y, 154M, 154C, and 154K with the encoder roller 14 to support the optical sensor unit 150 based on the position of the encoder roller 14, thereby maintaining a given distance and angle of the optical sensor unit 150 to the outer surface of the intermediate transfer belt 8. Accordingly, with the positioning angle 156, the optical sensor unit 150 can be accurately positioned to the intermediate transfer belt 8, based on the position of the encoder roller 14.

With the above-described configuration, the outer surface of the intermediate transfer belt 8 can be positioned with high accuracy to a focus point of each photosensor of the optical sensor unit 150. By so doing, the detection accuracy of each photosensor can be increased when compared with the positioning of the optical sensor unit 150 in reference to a different member.

Figure 13:
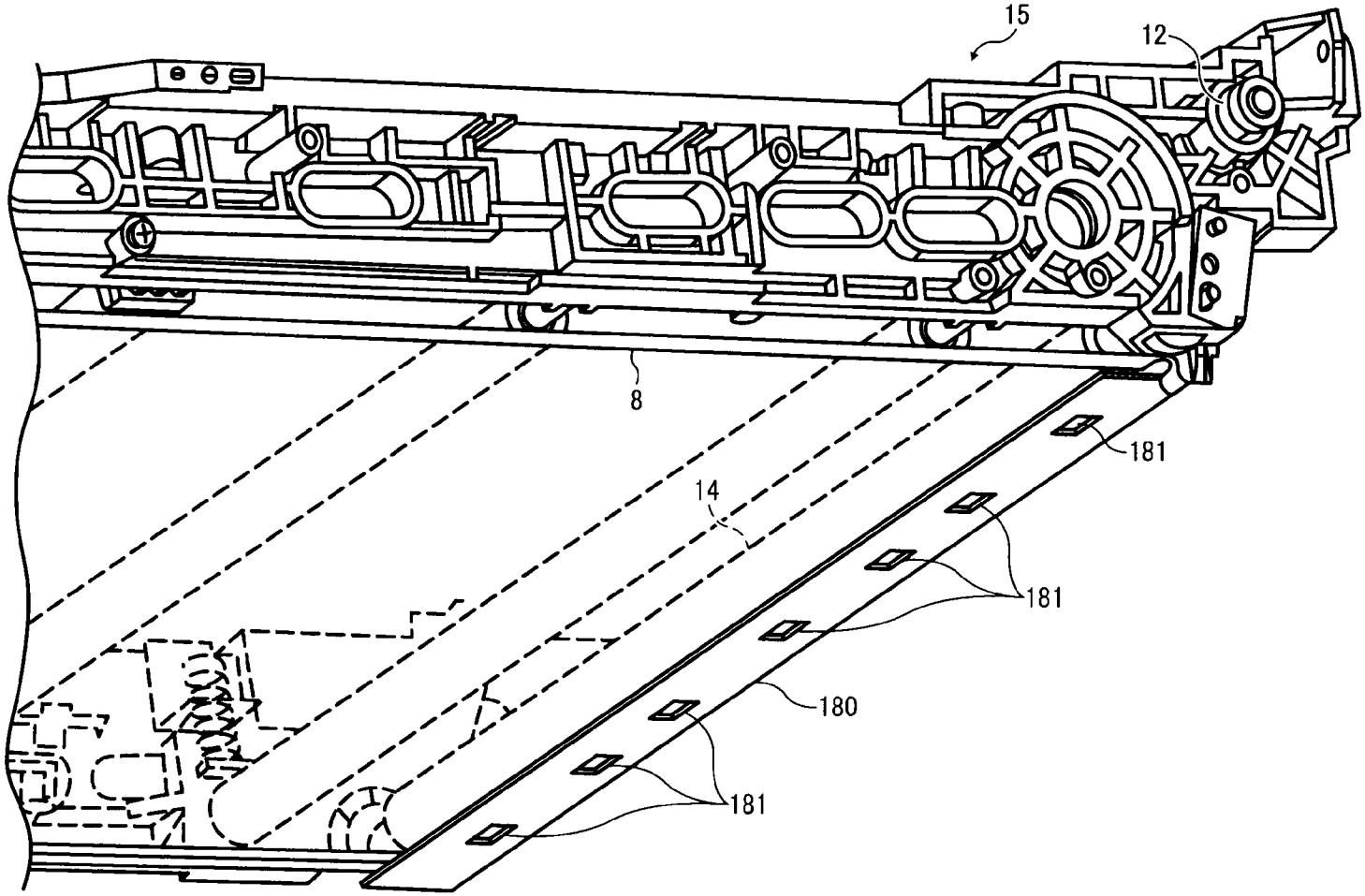
FIG. 13 is a partial enlarged view of a modified configuration of the transfer device.

Next, referring to FIG. 13, a modified configuration of the transfer device 15 of the printer 100 according to an exemplary embodiment of the present invention is described.

Elements and members corresponding to those of the printer 100 according to an exemplary embodiment shown in FIG. 12 are denoted by the same reference numerals and descriptions thereof are omitted or summarized. Although not particularly described, configurations of the printer 100 and operations that are not particularly described in this exemplary embodiment are the same as those of the printer 100 of the exemplary embodiment previously described with reference to FIG. 12.

In the printer 100 of FIG. 12 according to an exemplary embodiment of the present invention, the optical sensor unit 150 is fixed to the transfer unit 15 so that both the optical sensor unit 150 and the transfer unit 15 can be detached from and attached to the printer 100. By contrast, in the printer 100 according to the modified exemplary embodiment of the present invention in reference to FIG. 13, the optical sensor unit 150 is fixed to the printer 100 and the transfer device 15 can be detached from and attached to the printer 100 without including the optical sensor unit 150.

As shown, FIG. 13 is a partial enlarged view of one end portion of the transfer device 15 in a width direction of the intermediate transfer belt 8. The transfer device 15 of FIG. 13 includes a cover 180 disposed at the portion facing the encoder roller 14 to cover a substantially entire crosswise area from an outer surface of the intermediate transfer belt 8.

The cover 180 includes seven openings 181 arranged in a width direction of the intermediate transfer belt 8 or a longitudinal axis of the supporting rollers. The seven photosensors, not shown in FIG. 13, of the optical sensor unit 7 that are fixedly attached to the printer 100 can detect tone pattern images and/or patch pattern images formed on the intermediate transfer belt 8 through the respective openings 181.

In the above-described configuration, the encoder roller 14 that is highly rigid and has no eccentric and irregular shape can also serve as a driven roller that extends the intermediate transfer belt 8 at the portion facing the optical sensor unit 150. By so doing, the printer 100 can reduce the cost and obtain high detection accuracy when compared with a configuration in which a driven roller, which is highly rigid, free from eccentricity or irregularity, and different from the encoder roller 14, is disposed at the portion facing the optical sensor unit 150.

Instead of the opening 181, a window including an optically transparent material such as glass and transparent resin can be mounted on the support plate 155.

The above description has been given of the printer 100 that is designed to transfer respective toner images formed on the photoconductive drums 1Y, 1M, 1C, and 1K onto a recording medium via the intermediate transfer belt 8 so as to form a composite toner image. However, the present invention can also apply to an image forming apparatus that is designed to transfer the toner images directly onto the recording medium to form a composite color toner image.

In the printer 100 according to the exemplary embodiments of the present invention, the encoder roller 14 acting as a driven roller may be a reference member for positioning the optical sensor unit 150 serving as an image detector with respect to the intermediate transfer belt 8 serving as an endless belt member. The above-described configuration can increase accuracy in detection of each photosensor, when compared with a configuration in which the optical sensor unit 150 is positioned in reference to a different member.

Further, in the printer 100 according to the exemplary embodiments of the present invention, the optical sensor unit 150 serving as an image detector includes multiple photosensors aligned in a longitudinal axis of the encoder roller 14. With the above-described configuration, multiple gradation pattern images and/or multiple patch pattern images are detected concurrently by corresponding ones of the multiple photosensors. By so doing, when compared with a configuration having one photosensor, the printer 100 can reduce more time for the process control operation and the misregistration correction operation.

In the printer 100 according to the above-described modified exemplary embodiment of the present invention, the cover 180 is arranged to cover the front surface of the intermediate transfer belt 8 so that the optical sensor unit 150 can detect the reference toner images on the surface of the intermediate transfer belt 8 through the openings 181 formed thereon. The openings 181 of the cover 180 are disposed facing the encoder roller 14 via the intermediate transfer belt 8, and more specifically, are aligned in a longitudinal axis of the encoder roller 14 facing a specific area where the encoder roller 14 supports the intermediate transfer belt 8 in the direction of movement of the intermediate transfer belt 8. Different from the use of any driven roller, which has high rigidity, free from eccentricity and deformation, other than the encoder roller 14 disposed facing the optical sensor unit 150, the above-described configuration using the encoder roller 14 can provide higher accuracy in detection, thereby reducing time for the process control operation and the misregistration correction operation.

As described above, the printer 100 according to the modified exemplary embodiment of the present invention employs multiple openings 181 aligned on the cover 180 in the longitudinal axis or rotational axis of the encoder roller 14. Similar to the printer 100 according to an exemplary embodiment of the present invention, the above-described configuration includes multiple photosensors to concurrently detect the multiple gradation pattern images and/or multiple patch pattern images by corresponding ones of the multiple photosensors. By so doing, when compared with a configuration having one photosensor, the printer 100 can reduce more time for the process control operation and the misregistration correction operation.

The printer 100 according to an exemplary embodiment or a modified exemplary embodiment of the present invention includes the control unit 200 to serve as an image forming condition adjusting unit and as a drive speed adjusting unit.

As an image forming condition adjusting unit, the control unit 200 causes gradation pattern images including multiple reference toner images with different densities formed on the respective surfaces of the photoconductive drums 1Y, 1M, 1C, and 1K to be transferred onto the intermediate transfer belt 8, then causes the photosensors of the optical sensor unit 150 to detect the image densities of respective reference toner images in each of the gradation pattern images formed on the intermediate transfer belt 8, and adjusts the image forming conditions of the image forming mechanism including the optical writing device 7 and the process cartridges 6Y, 6M, 6C, and 6K based on the detection result.

As a drive speed adjusting unit, the control unit 200 adjusts the drive speed of the belt drive motor 162 serving as a drive source of the drive roller 12 based on the detection result obtained by the encoder 170 serving as a rotation speed detector.

The above-described configuration feeds back the detection result obtained by the encoder 170 to suppress the speed fluctuation of the intermediate transfer belt 8, and at the same time detects the gradation pattern images. This can suppress degradation of the detection accuracy of image forming ability caused by the fluctuation in speed of the intermediate transfer belt 8, and adjust the image forming condition appropriately. Specifically, as described above, when the speed of the intermediate transfer belt 8 changes during the transfer operation of toner images from the photoconductive drums 1Y, 1M, 1C, and 1K onto the intermediate transfer belt 8, the toner images can be transferred in improper size, e.g., extended or shrunk in the direction of movement of the intermediate transfer belt 8, and due to the change in image size, the density of the image can change compared to that before the transfer. Therefore, when the fluctuation in speed of the intermediate transfer belt 8 occurs during the transfer operation of the gradation pattern images in the above-described process control operation, the image densities of the gradation pattern images may change from these before the transfer operation. The change of image density causes the gradation pattern images formed on the intermediate transfer belt 8 not to properly reflect the image forming ability or image forming density of the optical writing unit 7 and the process cartridges 6Y, 6M, 6C, and 6K. By contrast, the printer 100 according to an exemplary embodiment and modified exemplary embodiment of the present invention transfers the gradation pattern images onto the surface of the intermediate transfer belt 8 while the above-described feedback control is suppressing the change in speed of the intermediate transfer belt 8. By so doing, deterioration of detection accuracy of image forming ability caused by the change in speed of the intermediate transfer belt 8 can be reduced or prevented.

Further, the printer 100 according to an exemplary embodiment or a modified exemplary embodiment of the present invention includes the control unit 200 to serve as an image forming condition adjusting unit and as a drive speed adjusting unit.

As an image forming condition adjusting unit, the control unit 200 causes the multiple reference toner images formed on the respective surfaces of the photoconductive drums 1Y, 1M, 1C, and 1K to be sequentially transferred in a single layer onto the intermediate transfer belt 8, then causes the photosensors of the optical sensor unit 150 to detect the reference toner images formed on the intermediate transfer belt 8, obtains the relative misregistration of the reference toner images, and adjusts the image forming conditions of the image forming mechanism including the optical writing unit 7 and the process cartridges 6Y, 6M, 6C, and 6K based on the detection result.

As a drive speed adjusting unit, the control unit 200 adjusts the drive speed of the belt drive motor 162 based on the detection result obtained by the encoder 170.

The above-described configuration suppresses the speed fluctuation of the intermediate transfer belt 8 according to the adjustment of the drive speed of the belt drive motor 162, and at the same time detects the patch pattern images. This can suppress detection errors of the misregistration caused by the speed fluctuation of the intermediate transfer belt 8, and perform the misregistration correction operation of each toner image appropriately.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A transfer device to transfer an image onto a recording medium directly or indirectly, the transfer device comprising:

an endless belt member extended between a drive roller rotated by a drive source thereof and a driven roller rotated with the drive roller, the endless belt member configured to receive the image formed on a surface of an image carrier part of an image forming apparatus onto either a surface thereof or the recording medium carried on the surface thereof while moving according to rotations of the drive roller;

an image detector configured to detect the image formed on the endless belt member directly or the recording medium carried on the endless belt member, the image detector disposed facing the driven roller in a circumferential direction of the endless belt member; and a rotation speed detector configured to detect a rotation speed of the driven roller, wherein the image detector is positioned based on a position of the driven roller with a positioning member, at an upstream side from the drive roller in a belt travel direction, and facing an outer surface of the endless belt member where an inner surface thereof is held in contact with the driven roller, and wherein the image detector comprises multiple sensors disposed along a longitudinal axis of the driven roller.

2. A transfer device to transfer an image onto a recording medium directly or indirectly, the transfer device comprising:

an endless belt member extended between a drive roller rotated by a drive source thereof and a driven roller rotated with the drive roller, the endless belt member configured to receive the image formed on a surface of an image carrier part of an image forming apparatus onto either a surface thereof or the recording medium carried on the surface thereof while moving according to rotations of the drive roller;

a cover covering an outer surface of the endless belt member, including either an opening therein or a window made of transparent material and disposed facing an area where the driven roller supports the endless belt in a direction of movement of the endless belt member;

an image detector fixed to an image forming apparatus to detect the image formed on the endless belt member through the opening or the window in the cover; and a rotation speed detector configured to detect a rotation speed of the driven roller.

3. The transfer device according to claim 2, wherein the cover comprises multiple openings or multiple windows disposed along a longitudinal axis of the driven roller.

4. An image forming apparatus, comprising:

an image carrier part configured to carry an image on a surface thereof;

an image forming mechanism configured to form the image on the surface of the image carrier;

a transfer device configured to transfer the image onto a recording medium directly or indirectly, the transfer device comprising:

an endless belt member extended between a drive roller rotated by a drive source and a driven roller rotated with the drive roller, the endless belt member configured to receive the image from the image carrier part onto either a surface thereof or the recording medium carried on the surface thereof while moving according to rotations of the drive roller, and a rotation speed detector configured to detect a rotation speed of the driven roller;

an image detector configured to detect the image formed on the endless belt member directly or the recording medium carried on the endless belt member, the image detector disposed facing the driven roller in a circumferential direction of the endless belt member; and a cover covering an outer surface of the endless belt member, including either an opening therein or a window made of transparent material and disposed facing an area where the driven roller supports the belt member in a direction of movement of the endless belt member, the image detector detecting the image formed on the endless belt member through the opening or the window in the cover.

5. The image forming apparatus according to 4, wherein the cover comprises multiple openings or multiple windows disposed along a longitudinal axis of the driven roller.

6. The image forming apparatus according to claim 4, wherein the image carrier part comprises multiple individual image carriers configured to carry respective images thereon, the transfer device sequentially transferring the respective images onto either the endless belt member or the recording medium carried on the endless belt member.

7. The image forming apparatus according to claim 6, further comprising:

an image forming condition adjusting unit configured to transfer gradation pattern images including multiple images with different image densities formed on the respective surfaces of the multiple image carriers onto the endless belt member, detect the image densities of respective images in each of the gradation pattern images formed on the endless belt member with the image detector, and adjust image forming conditions of the image forming mechanism based on a detection result obtained by the image detector; and a drive speed adjusting unit configured to adjust a drive speed of the drive source of the drive roller based on a detection result obtained by the rotation speed detector.

8. The image forming apparatus according to claim 6, further comprising:

an image forming condition adjusting unit configured to sequentially transfer the images formed on the respective surfaces of the image carriers in a single layer onto the endless belt member, detect the images formed on the endless belt member with the image detector, obtain relative positions of the respective images, and adjust image forming conditions of the image forming mechanism based on a detection result obtained by the image detector; and a drive speed adjusting unit configured to adjust a drive speed of the drive source of the drive roller based on a detection result obtained by the rotation speed detector.

* * * * *